United States Patent [19]

Guimier et al.

[11] 4,121,950

[45] Oct. 24, 1978

[54] FORGED NICKEL ALLOY PRODUCT AND METHOD

[75] Inventors: Alain R. Guimier, Versailles; Jean-Loup B. V. Strudel, Mennecy, both of France

[73] Assignee: Association pour la Recherche et le Developpement des Methods et Processus Industriels (A.R.M.I.N.E.S.), Paris, France

[21] Appl. No.: 736,324

[22] Filed: Oct. 28, 1976

[30] Foreign Application Priority Data

Oct. 31, 1975 [FR] France ..... 75 33888

[51] Int. Cl.[2] ..... C22F 1/10

[52] U.S. Cl. ..... 148/12.7 N; 75/171; 148/32.5; 148/162

[58] Field of Search ..... 75/171, 170; 148/32, 148/32.5, 12.7 N, 162

[56] References Cited

U.S. PATENT DOCUMENTS

| | | | |
|---|---|---|---|
| 3,677,746 | 7/1972 | Lund et al. | 75/171 |
| 3,748,192 | 7/1973 | Boesch | 75/171 |

*Primary Examiner*—R. Dean

*Attorney, Agent, or Firm*—Bacon & Thomas

[57] ABSTRACT

An alloy of nickel-chrome-cobalt comprising in parts by weight at least 2% aluminum, at least 0.10% titanium and 0.30–1.50% hafnium. The alloy is particularly useful for forming forged products such as turbine components and the like normally subjected to high temperature conditions.

10 Claims, 2 Drawing Figures

FORGED NICKEL ALLOY PRODUCT AND METHOD

BACKGROUND OF THE INVENTION

The present invention relates to forged alloys having a basic nickel-chrome-cobalt composition and further includes at least titanium and aluminum as additional components for the purpose of producing a coherent phase that is achieved by thermal treatment for structural hardening. In this context, the expression "forged alloy" is intended to include those alloys which are subjected to plastic deformation at varying temperature levels for the purpose of forming the desired metal products. For example, such plastic deformation may be achieved by hammering, welding, molding, rolling and other similar and well known metallurgical techniques.

The field of alloys to which the invention pertains includes practically no iron except for that amount which is included or occurs as residual impurity. These alloys are particularly characterized by their resistance to oxidation and corrosion under heat conditions because of the chrome and aluminum constituents in the basic composition. A high cobalt content is also desirable for these alloys for the purpose of imparting forgeability under the application of heat. It is further advantageous if these alloys include titanium, aluminum, molybdenum and/or tungsten since these elements contribute in conferring significant mechanical properties to the alloys at temperatures up to approximately 850° C. or such temperatures up to which these elements occur in solid solution within the nickel-cobalt-chrome matrix. In consideration of appropriate thermal treatment, the most significant factor of alloy hardening is the presence of the gamma prime phase of the cubic molecular arrangement of the structure Ni3(Ti,Al), which structure is precipitated by thermal treatment and in which structure cobalt and chrome may substitute for part of the nickel.

Because such alloys are resistant to corrosion and oxidation under heat conditions, exhibit good creep behavior and possess outstanding mechanical properties under temperature conditions between 500° and 1000° C., they are utilized to produce forged products for a variety of high temperature applications, such as turbines for the aircraft and similar industries. However, such known alloys normally undergo a significant loss of ductility at a temperature range of from 650°–800° C. This loss corresponds to a low in the curve of elongation at rupture as a function of temperature, the minimum of which can be at less than 1%. This disadvantage necessitates the implementation of various precautions during the forging or similar mechanical operations, thereby limiting the applications of such alloys.

SUMMARY OF THE INVENTION

It is therefore an object of this invention to provide a new range of compositions for forging alloys wherein the forged products are characterized by a close grain structure which does not show a decrease in ductility at high temperature levels.

It is another object of the invention to provide for alloys which can be easily deformed at varying temperature levels, including cold or hot temperatures.

It is a further object of the invention to provide for alloys that can be easily soldered and exhibit improved limits of elasticity and higher resistance to thermal deformation after heat treatment than do heretofore known alloys of the same class.

It is yet a further object of the invention to provide alloys which are particularly well suited for making disks and flanges for turbines and compressor motors and other similar applications utilizing movable blades and wherein such products are thermally forged or cast, including articles of soldered plates such as cases for turbines, tuyeres and the like.

The forging alloys according to the invention are based upon a nickel-chrome-cobalt composition which also includes aluminum and titanium. The basic alloy of the invention includes the following components in percent by weight:

| | |
|---|---|
| Cobalt: | 13–20% |
| Chrome: | 13–19% |
| A metal selected from the group consisting of molydbenum, tungsten and mixtures thereof: | 3–6% |
| Carbon: | 0.01–0.2% |
| Aluminum: | 2–4% |
| Titanium: | 0.10–3% |
| Hafnium: | 0.30–1.50% |
| Nickel: | remainder |

The alloy may further include low amounts of elements like boron or zirconium which assist in the precipitation of the links between the metal grains. Preferably, the total content of aluminum and titanium is about 4–7% by weight and the ratio between the titanium content and aluminum content is about 0.20–1.5. It is also preferred that the alloys according to this invention are prepared by melting under vacuum by means of arc or induction heating. These alloys may also be utilized in the practice of known powder metallurgy techniques.

The preparation of the forged alloys include the steps of welding or hammering, which steps are necessary to achieve refining of the metal grain. Such treatment would not be affected by the subsequent thermal treatment due to the presence of primary intergranular carbides which are formed during the first stage of the hereinafter described thermal treatment which includes three stages.

The first stage serves to place the gamma prime phase back into partial or complete solution, the second stage initiates the growth of the carbides and the beginning of the precipitation of the gamma prime phase and the third stage serves to complete the precipitation of the gamma prime phase.

In the first stage, a complete resolution has to be reached and this is effected by annealing the alloy at a temperature from 1050°–1200° C. for at least one hour so that a relatively low limit of elasticity is achieved by the later stages of precipitation, but which is nevertheless superior to that of heretofore known alloys. Good thermal stability may be achieved by utilizing temperatures up to about 850° C. A partial resolution of the gamma prime phase is reached in the first stage at temperatures between about 950°–1050° C. During the heating, a considerable amount of primary carbides are precipitated, some in intragranular form and the main portion being in intergranular form. As will be hereinafter seen, the equiaxial morphological structure of the primary carbides which contain hafnium produce an effective blocking of the grains and thereby inhibit subsequent recrystallization during the use of the forged alloys. The restoration of the alloy structure during mechanical working is hindered by the presence of undissolved portions of the gamma prime phase. After the stages of reprecipitation, this method of partial redissolving provides higher elasticity limits than those of known alloys for utilization at temperatures between 500°-700° C.

The second stage of treatment comprises heating the alloy products to a temperature near 850° C. for 10-30 hours. This produces growth of carbides M26C6 by coalescence and the initiation of the precipitation of the hardening gamma prime phase.

Finally, the third stage comprises treating the material at temperatures around 760° C. for 10-30 hours, thereby effecting the complete precipitation of the gamma prime phase.

It has heretofore been known to incorporate hafnium in alloys for the purpose of improving their casting ability and to increase their ductility at cold and medium temperature levels. It has also been proposed to incorporate hafnium into forged alloys which are based on a nickel-chrome-iron composition and a cobalt-nickel-chrome composition in order to increase their ductility at high temperature and decrease their sensitivity to notching. Finally, it has already been suggested in the prior art to replace niobium by hafnium in nickel-cobalt-chrome alloys containing titanium and aluminum. However, the aluminum content in these alloys does not exceed 2% because, based upon tests which have been undertaken with alloys containing niobium, it was suspected that a higher content of aluminum would decrease mechanical resistance characteristics at low and high temperatures.

However, the present invention has demonstrated to the contrary that the incorporation of hafnium is compatible with a content of aluminum above 2% in nickel-cobalt-chrome forging alloys containing aluminum and titanium.

BRIEF DESCRIPTION OF THE DRAWINGS

The invention will be better understood and the advantages thereof be appreciated when taken in consideration of the disclosed examples and drawings wherein.

DETAILED DESCRIPTION OF THE PREFERRED EMBODIMENTS

Figure 1:
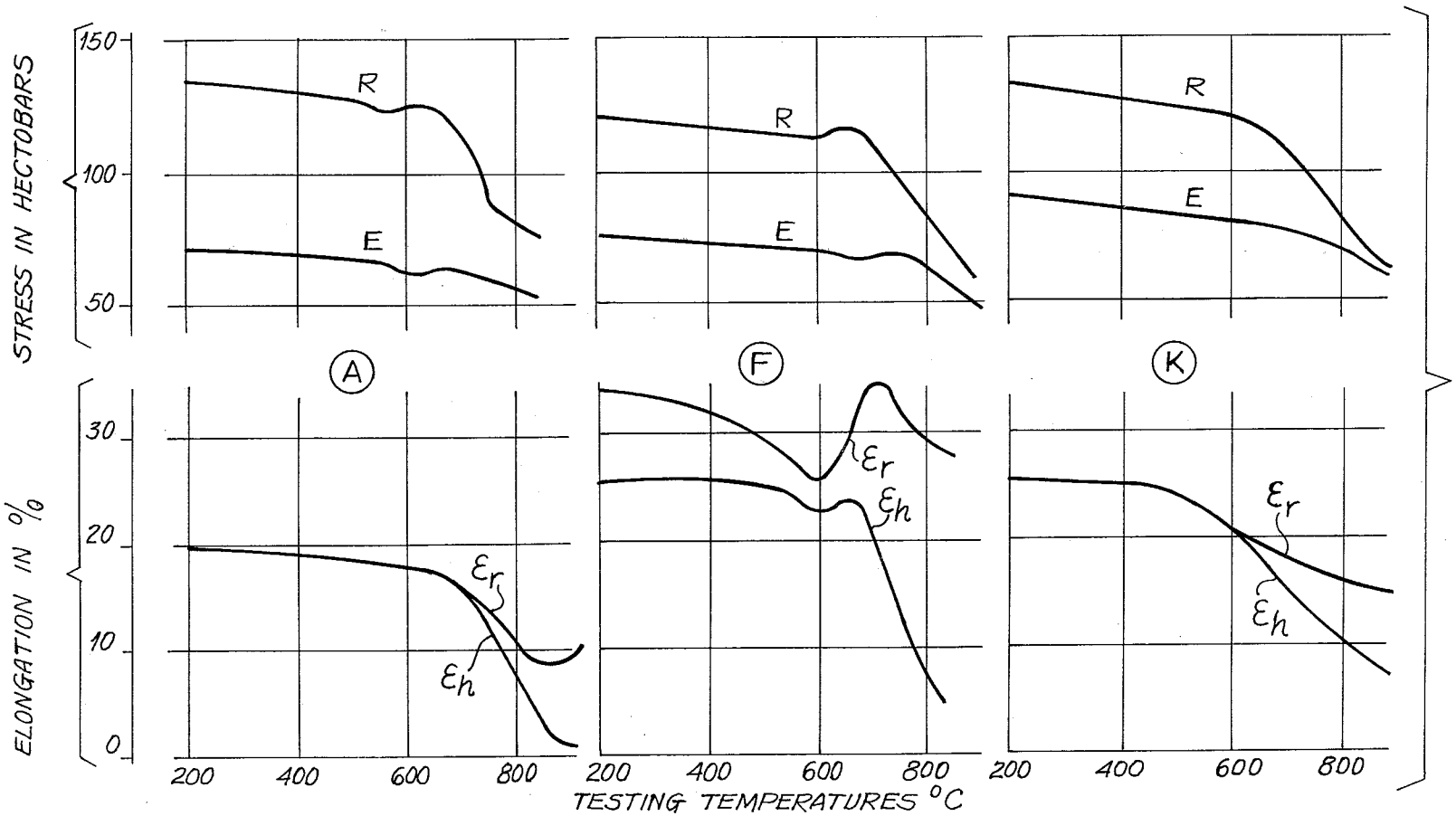
FIG. 1 is a series of comparative graphs which depict the results of elongation tests on several alloys at different temperatures.

The alloy compositions according to the present invention are determined according to several considerations. The cobalt content, which content is in the range of 13-20% of the total composition, is fixed as a proportion of the intended volume of the portion which is made up by the precipitated gamma prime phase in order to maintain forgeability. The molybdenum and/or tungsten components stay in solid solution in the nickel-cobalt-chrome matrix and contribute to increasing the hardness of this matrix up to about 850° C. Appreciable hardening is achieved with a molybdenum and/or tungsten content from about 3% of the total composition. A molybdenum and/or tungsten content above about 6% causes carbides of acicular structures to form which causes the resulting alloy product to be more brittle.

It is within the precipitated phase of the type Ni3(Ti,Al), that the hafnium exhibits part of its effects. As has been previously indicated, cobalt and nickel partially substitute each other. In addition, the hafnium takes the place of part of the titanium in order to increase the hardness of this phase, the composition of which alloys according to the invention is of the type M3(Al,Ti,Hf) in which M signifies nickel, cobalt or chrome.

It has been ascertained by electronic microscopy studies that the dispersed M phase of alloys according to the invention generates a larger number of microtwins which belong to various slipping systems, thereby producing a homogeneous deformation even at very high levels of stress or, in other words, an isotropic ductility in each grain of the alloy. In comparative tests which were conducted on alloys of similar compositions but not containing hafnium, indications were the presence of a much smaller number of longer twins under strong stress. These twins belong to only one system and, as such, produce fissuring, corrosion and oxidation at the grain boundaries. It is clear that this difference accounts for the superior ductility of the alloys according to the present invention.

The range of the total content of titanium and aluminum being 4-7% by weight corresponds to about 8-15% of the atoms. The actual amount which has to be used, based upon the volume of the precipitated portion of the hardening phase, depends on the mechanical characteristics desired. With regard to the titanium-aluminum ratio, which can vary from 0.2 to 1.5 in weight corresponding from 0.1 to 0.7 in atomic concentration, it is noted that this ratio has to be chosen as a function of the level of stress which will be imposed during utilization of the alloys. A low ratio corresponds to alloys which are ductile and exhibit very little sensitivity towards notching and consequently guarantees greatest reliability for products which are exposed to stress of a low level. The highest values will be reserved for alloys that are to be subjected to higher flow stresses during creeping and simultaneously exhibit an acceptable elongation at rupture value.

The carbon content can vary between 0.01 and 0.20% and permits the precipitation of many carbides during the second and the third stage of the aforementioned thermal treatment. The primary carbides are precipitated during the second stage and are carbides of hafnium and/or niobium of compact and equiaxial morphological structure. These carbides are located in the boundaries of the grains as well as in the matrix. The presence of hafnium initiates the forming of this very hard dispersed phase in the alloys at high temperatures and thereby contributes to homogenization of the deformations under stress at very high temperatures during utilization and, consequently, improves the ductility of the material at such temperatures. In this regard, the risks of recrystallization are eliminated. These beneficial effects are gradually produced when the hafnium content reaches 0.3%. However, when the hafnium content exceeds about 1.5%, there is a risk of producing ingots having rough particles and cracks resulting from segregations of hafnium.

During the third stage of the thermal treatment, secondary carbides of the type M23C6 are precipitated within the boundaries of the grains as well as within the boundaries of the incoherent twins. Thus, an anchoring is created which permits the materials to resist shearing stresses that develop at high temperatures during use.

The precipitation in the boundaries of the grains may be enhanced by the presence of low quantities of boron and zirconium in the alloys of this invention. The maximum content of boron should not exceed about 0.02% and the maximum content of zirconium should not exceed about 0.10%.

It is advantageous to limit the content of impurities such as sulfur or silicon to values of less than 0.5% in order to preserve the weldability of the alloys.

As non-limitative examples of comparisons between the compositions of the present invention and that of the prior art, reference is hereby made to the following Table I which provides the results of mechanical tests that have been effected on the compared sample alloys:

TABLE I

| ALLOY | Composition (% by weight) | | | | | | | | | |
|---|---|---|---|---|---|---|---|---|---|---|
| | Ni | Co | Cr | Al | Ti | Mo | Hf | Zr | B | C |
| A | remainder | 13 | 18 | 1.50 | 3 | 4 | 0 | 0.06 | 0.01 | 0.06 |
| F | remainder | 13 | 18 | 3 | 1 | 4 | 1 | 0.06 | 0.01 | 0.06 |
| K | remainder | 18 | 18 | 4 | 1.50 | 4 | 1 | 0.06 | 0.01 | 0.06 |

As seen in Table I, alloy A is a prior art alloy that is known and commercially available. Alloys F and K are sample alloys according to the present invention and are different from alloy A in that they comprise 1% hafnium and the ratios of titanium to aluminum is reversed as to the corresponding ratio of these latter metals for alloy A. Alloy K, after thermal treatment in which the total content of aluminum and titanium is markedly higher than that of alloys A and F, includes a higher portion in volume of hardening compounds. The cobalt content was adjusted accordingly. These three alloys were taken from blank forged material and sample alloys F and K were then thermally treated according to the invention as follows:

Stage 1 — 4 hours at 1080° C., with air hardening
Stage 2 — 24 hours at 850° C.
Stage 3 — 16 hours at 760° C. with air hardening This treatment corresponds to the lowest values which can be expected for the limit of elasticity for the three alloys at high temperatures or at room temperature.

Referring now to FIG. 1, there are depicted the results of a series of fast pulling tests which were effected on the treated samples of alloys A, F and K at different temperatures. For each alloy, the curves R and E depict the development of the rupture loads and the limits of elasticity at 0.2%, respectively, wherein E is expressed in hectobars and the various temperatures expressed in degrees centigrade. The curves $E_r$ and $E_h$ depict the development of the elongation of rupture expressed in percent with and without reduction in area at the same temperatures. It can therefore be seen that, within the investigated range of temperatures, the limit of elasticity of alloys F and K according to the present invention is distinctly higher than that of prior art alloy A. The elongation at rupture, with or without reduction in area of alloys F and K, are also distinctly higher than that of alloy A. Finally, alloy F indicates a maximum ductility at about 700° C. which is exactly the temperature at which the ductility of alloy A starts to decrease markedly.

Figure 2:
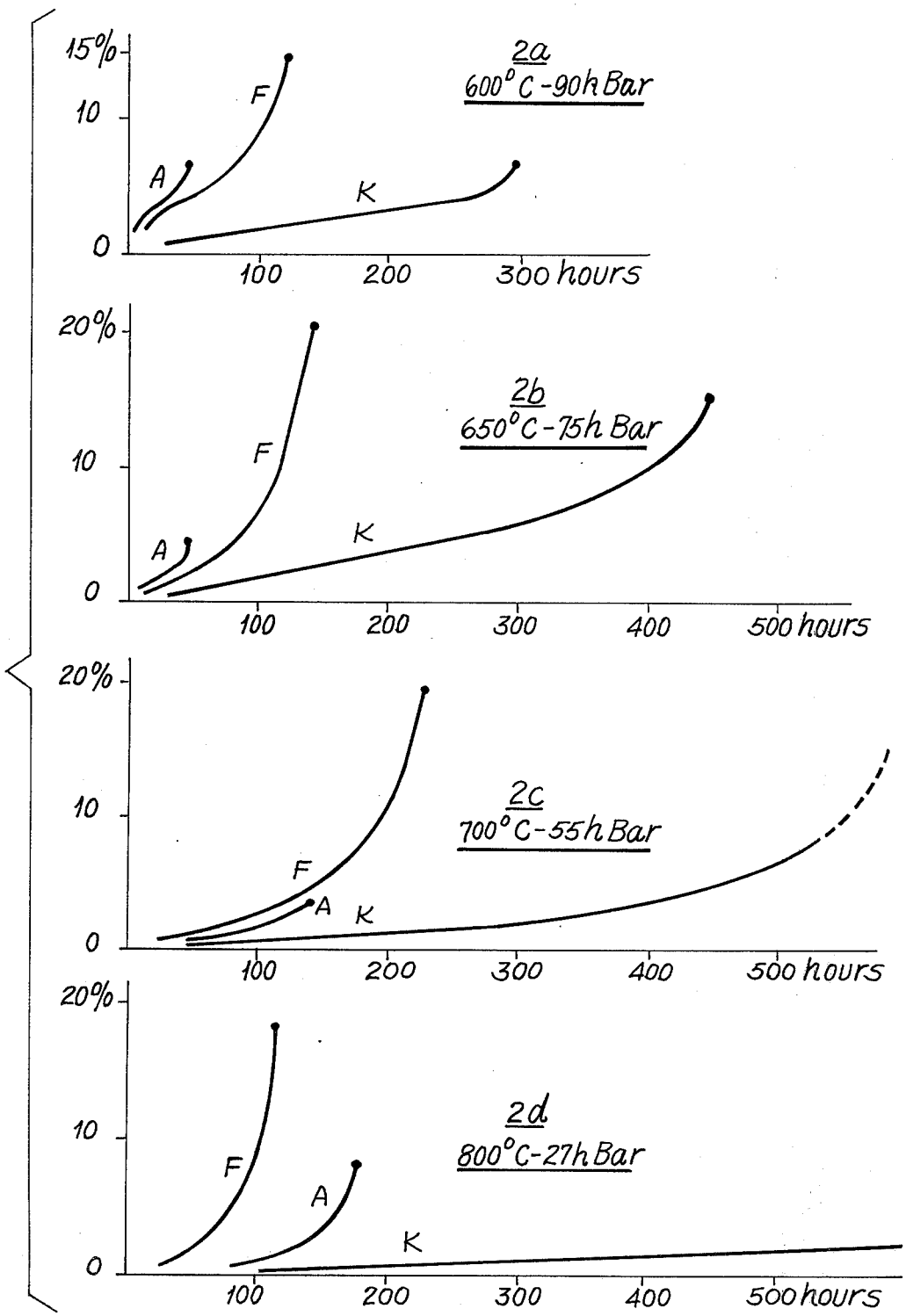
FIG. 2 is a series of comparative graphs depicting the results of creep tests under constant load which were followed by rupture at different temperatures for several alloys.

These results are confirmed by the curves depicted in FIG. 2 which show the development of the elongation of the three alloys versus temperature during pulling tests at high temperatures and constant loading. Such loading was applied to the rupture points at different pairs of values of temperature and stress as follows:

600° C., 90 hectobars for the curves 2*a*
650° C., 75 hectobars for the curves 2*b*
700° C., 55 hectobars for the curves 2*c*
800° C., 27 hectobars for the curves 2*d*

The percent of elongation is indicated at the ordinate and the time is indicated in hours at the abscissa of each graph in FIG. 2.

It can be seen, that at all testing temperatures, alloy F indicates a ductility which is much superior to that of alloy A. Alloy K contains more titanium and aluminum than alloy F, thereby exhibiting a higher creeping resistance and a higher ductility which provides for excellent forgeability of this alloy. An investigation of cracks indicate that alloy A exhibited intergranular ruptures which are affected by traces of oxidation at the peripheries whereas alloys F and K according to the invention exhibited transgranular cracks at cupules.

Alloy K is particularly useful in the manufacture of forged disks which are subjected to substantial mechanical and/or heat stress during their utilization.

Tests of creep elongation were conducted on these same alloys in order to ascertain the stress which would produce an elongation of 0.2% during 300 testing hours for each alloy. The results are provided in the following Table II:

TABLE II

| ALLOYS | Stresses in hectobars for 0.2% elongation within 300 hours at temperatures of: | | |
|---|---|---|---|
| | 550° C | 650° C | 750° C |
| A | 55 | 41 | 21 |
| F | 78 | 53 | 27 |
| K | | 67 | 32 |
| A' | 65 | 48 | 16 |
| F' | 86.5 | 60 | 25 |

As indicated in Table II, the data for alloys A, F and K provide the results for treatment as indicated earlier. The data for A' and F' correspond to alloys A and F which had undergone a thermal treatment that is more appropriate for the manufacture of disks for turbines of compressors, i.e.:

4 hours at 1010° C., with air hardening;
4 hours at 850° C.; and
16 hours at 760° C., with air hardening.

It can be seen that the alloys of the invention can withstand a flow stress which is markedly higher than that which alloy A can stand at the same temperature and the same deformation (the flow resistance of alloy K is 50% higher). Under the same mechanical stress conditions, the alloys according to this invention can be exposed to distinctly higher temperatures than that of known prior alloys. As is further demonstrated by the results of the foregoing tests, the advantages of the invention alloys are accompanied by a noticeable increase of reliability due to increased capacity for deformation before rupture.

It is to be understood that the embodiments of the invention herewith shown and described are to be taken as preferred examples of the same, and that various changes may be resorted to without departing from the spirit of the invention or the scope of the subjoined claims.

We claim:

1. A process for the thermal treatment of forged nickel-cobalt-chrome alloys characterized by the presence of a gamma prime phase having a molecular structure of cubic arrangement and consisting essentially of, in percentage parts by weight:

| | |
|---|---|
| cobalt | 13–20% |
| chrome | 13–19% |
| a metal selected from the group consisting of molybdenum, tungsten and mixtures thereof | 3–6% |
| carbon | 0.01–0.20% |
| aluminum | 2–4% |
| titanium | 0.10–3% |
| hafnium | 0.30–1.50% |
| nickel | remainder |

which process comprises the steps of:

(a) placing at least a portion of the gamma prime phase back into solution, (b) effecting the coalescence of carbides and the initiation of the reprecipitation of the gamma prime phase, and (c) completing the reprecipitation of the gamma prime phase.

2. The process of claim 1 wherein the total content of aluminum and titanium is 4–7%.

3. The process of claim 1 wherein the ratio by weight of the titanium content to the aluminum content is from 0.20 to 1.5.

4. The process of claim 1 further including a constituent selected from the group consisting of up to about 0.10% zirconium, up to about 0.05% boron and mixtures thereof.

5. The process of claim 4 wherein:

| | |
|---|---|
| Cobalt | 13% |
| Chrome | 18% |
| Aluminum | 3% |
| Titanium | 1% |
| Molybdenum | 4% |
| Hafnium | 1% |
| Zirconium | 0.06% |
| Boron | 0.01% |
| Carbon | 0.06% |
| Nickel | remainder |

6. The process of claim 4 wherein:

| | |
|---|---|
| Cobalt | 18% |
| Chrome | 18% |
| Aluminum | 4% |
| Titanium | 1.5% |
| Molybdenum | 4% |
| Hafnium | 1% |
| Zirconium | 0.06% |
| Boron | 0.01% |
| Carbon | 0.06% |
| Nickel | remainder |

7. The process of claim 1 wherein:

(a) the placing of at least a portion of the gamma prime phase into solution is effected by heating the alloy at a temperature of from approximately 1050° C. to 1200° C. for at least 1 hour, (b) the coalescence of the carbides and the initiation of the reprecipitation of the gamma prime phase is effected by heating the alloy at approximately 850° C. for a period of approximately 10–30 hours, and (c) the completing of the reprecipitation of the gamma prime phase is effected by heating the alloy at approximately 760° C. for a period of approximately 10–30 hours.

8. The process of claim 1 wherein:

(a) the placing of at least a portion of the gamma prime phase into solution is effected by heating the alloy at approximately 1080° C. for approximately 4 hours followed by air hardening, (b) the coalescence of the carbides and the initiation of the reprecipitation of the gamma prime phase is effected by heating the alloy at approximately 850° C. for approximately 24 hours, and (c) the completing of the reprecipitation of the gamma prime phase is effected by heating the alloy at approximately 760° C. for approximately 16 hours followed by air hardening.

9. The process of claim 1 wherein:

(a) the placing of at least a portion of the gamma prime phase back into solution is effected by heating the alloy at approximately 1010° C. for approximately 4 hours followed by air hardening, (b) the coalescence of carbides and the beginning of the reprecipitation of the gamma prime phase is effected by heating the alloy at approximately 850° C. for approximately 4 hours, and (c) the completing of the reprecipitation of the gamma prime phase is effected by heating the alloy at approximately 760° C. for approximately 16 hours followed by air hardening.

10. The alloy product produced by the process of claim 1.

* * * * *

UNITED STATES PATENT OFFICE

CERTIFICATE OF CORRECTION

Patent No. 4,121,950 Dated October 24, 1978

Inventor(s) Alain R. GUIMIER and Jean-Loup B.V. STRUDEL

It is certified that error appears in the above-identified patent and that said Letters Patent are hereby corrected as shown below:

On the front page, under the Assignee, change "Association pour la Recherche et le Developpement des Methods et Processus Industriels (A.R.M.I.N.E.S.), Paris, France" to --Association pour la Recherche et le Developpement des Methodes et Processus Industriels (A.R.M.I.N.E.S.), Paris, France and Societe Nationale d'Etude et de Construction de Moteurs d'Aviation, Paris, France--

Signed and Sealed this

*Tenth* Day of *April 1979*

[SEAL]

*Attest:*

RUTH C. MASON
*Attesting Officer*

DONALD W. BANNER
*Commissioner of Patents and Trademarks*